US006662707B1

(12) United States Patent
Stolzer

(10) Patent No.: US 6,662,707 B1
(45) Date of Patent: Dec. 16, 2003

(54) AXIAL PISTON ENGINE

(75) Inventor: Rainer Stolzer, Neu-Ulm (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 0 days.

(21) Appl. No.: 09/914,959

(22) PCT Filed: Feb. 28, 2000

(86) PCT No.: PCT/EP00/01622

§ 371 (c)(1),
(2), (4) Date: Dec. 4, 2001

(87) PCT Pub. No.: WO00/52332

PCT Pub. Date: Sep. 8, 2000

(30) Foreign Application Priority Data

Mar. 3, 1999 (DE) ..... 199 09 311

(51) Int. Cl.[7] ..... F01B 3/00
(52) U.S. Cl. ..... 92/71; 92/129
(58) Field of Search ..... 92/71, 129; 91/499; 417/269; 74/60

(56) References Cited

U.S. PATENT DOCUMENTS 3,605,565 A 9/1971 Berezinski et al.
3,810,419 A 5/1974 Smith

FOREIGN PATENT DOCUMENTS

DE 2 101 213 9/1971
DE 39 40 441 A1 6/1991
DE 197 53 654 A1 6/1999
EP 0 921 312 A2 6/1999

*Primary Examiner*—Edward K. Look
*Assistant Examiner*—Michael Leslie
(74) *Attorney, Agent, or Firm*—Scully, Scott, Murphy & Presser

(57) ABSTRACT

The invention relates to an axial piston engine (1) comprising a housing (2) and a cylinder drum (5) that is pivotably arranged in one interior space (3) of the housing. Several cylinder bores (6) are embodied in said cylinder drum (5). Pistons (7) are moveably guided in said cylinder bores (6) and rest on a swash plate (11) by means of guide shoes (8). The axial piston engine (1) also comprises a retracting device (15). The guide shoes (8) rest on the retracting device (15) when the pistons (7) are retracted. A restraint system (16) is accommodated in the housing (2), can be moved against a spring (40) and is used for supporting the retracting device (15) at the housing (2). The aim of the invention is to improve and stabilise the support of the retracting device (15). To this end, the retracting device (15) is supported by a support device **(16*a*) which is situated behind the retracting device (15) at the side facing away from the swash plate (11). The support device is connected to the swash plate (11). The restraint system (16) supports the back of an essentially radial locating face (11*a*) at the swash plate (11) or an add-on piece thereof when the restraint system (16) is pushed into the interior space (3)** of the housing.

27 Claims, 5 Drawing Sheets

AXIAL PISTON ENGINE

The invention relates to an axial piston machine according to the precharacterising clause of claim 1 or 2.

An axial piston machine of this type is described in DE-A 21 01 213. In this previously known axial piston machine, the restraint device for supporting the retracting device is formed by holding plungers which are mounted to be radially displaceable in radial guide holes in the housing and are prestressed radially inwards by springs, the plungers having at their inner ends oblique faces which are inclined towards the adjacent retracting device relative to the associated radial plane and engaging, with these oblique faces, behind the outer border of a perforated disc forming the retracting device. This known restraint device has the following disadvantages owing to the oblique faces. If the inclination of the oblique faces is too great, there is the risk of the perforated disc pressing the holding plungers outwards owing to the axial tensile force of the pistons, with the result that the holding plungers lose their stability and are able to exert only a reduced restraining force on the perforated disc, or none at all. In such a case, there is the risk of the perforated disc being overstressed by the axial tensile force of the pistons and, for example, warped. It should be borne in mind here that the holding plungers are particularly inclined to yield outwards owing to vibrations which are present when the axial piston machine is in operation and to the radial force components which act on the oblique faces. If, in contrast, the inclination of the oblique faces is too small, there is the risk of the holding plungers jamming on the perforated disc, with the result that the rotary operation would be impaired and, because of wear, an inadequate service life would have to be expected.

Another major disadvantage of the known axial piston machine is that, owing to the fact that they project into the housing interior space, the holding plungers interfere with the mounting or demounting of the components arranged in the housing interior space.

The object on which the invention is based is to construct a restraint device of the type specified at the outset such that reliable functioning and a long service life can be obtained.

This object is achieved by the features of claims 1 or 2.

In the inventive configuration according to claim 1, the restraint device cooperates with a nonrotating component, namely the swash plate, the retracting device cooperating with a supporting device engaging behind it and connected to the swash plate. This gives rise to another support for the retracting device, namely on the swash plate, on which mutual support can be achieved in a simple and stable manner with relatively large supporting areas, with the result that low wear coupled with reliable support is ensured even with a rotating retracting device.

In the configuration according to claim 2, the restraint device is not mounted on the housing, but on the swash plate. This likewise enables the above-described advantages to be achieved, and in addition simple production is possible since the constructional features for the arrangement and mounting of the restraint device on the swash plate can be formed on the latter in a simple and cost-effective manner. This is due not only to the fact that the swash plate is a relatively small component, but is also a component with a high degree of processing, on which the additional features for the arrangement of the restraint device can be realised efficiently in one procedure. claims 3 to 25 contain advantageous developments of the invention.

According to a development of the invention, when the axial piston machine is in operation, the restraint device is displaced in a self-acting manner or automatically from a release position releasing the retracting device into a working position engaging behind the retracting device and, once the operation has been stopped, is automatically displaced into its release position again, the displacement into the working position being effected by the pressure of an adjoining or adjacent pressure space which is present or a pressure line and the displacement into the release position being effected by the force of a spring. By pressurising the restraint device with an internal pressure which is present when the axial piston machine is in operation or an external pressure, for example from an adjacent axial piston machine, it is possible in a simple manner to produce a pushing-in force which is greater than the retracting or pushing-against force required, so that in operation the position of the restraint device in its working position is reliably ensured. Owing to the automatic movement of the restraint device into its release position, it is not necessary, during mounting or demounting, for any special attention to be paid or any adjusting work performed to move the restraint device into its release position. This ensures simple and rapid mounting or demounting, while ensuring a stabilised retracting device and reliable operation.

In the case of an axial piston machine of the present type, suction forces act on the pistons in pump operation or when the axial piston machine in motor operation performs a braking function, which forces try to lift the slide shoes and thus the retracting device off from the swash plate. In the configuration according to the invention, such axial loads are not damaging even if they overload the retracting device, since the latter finds additional support and stabilisation on the restraint device and is able to take up the loads without damage.

The retracting device is to be arranged in the region of the lateral half of the axial piston machine in which the pistons perform a suction stroke, this region extending approximately over 180°. A restraint device arranged preferably centrically in the region of this lateral half, or a plurality of restraint devices arranged on this lateral half, are, in the case of an axial piston machine adapted for pump operation, also able to function in cases where the axial piston machine performs a motor operation owing to a braking function. In the case of axial piston machines movable in both directions of rotation, one or more restraint devices are to be arranged in each case in the region of the two lateral halves.

A particularly stable support for the retracting device arises when the area on the restraint device provided for the support is a radial area relative to the axis of rotation of the axial piston machine.

An advantageous embodiment for a restraint device is a stop peg of preferably circular cross-section which is mounted to be displaceable in a radial guide hole in the housing between the working position and the release position. It is advantageous to provide the pin in its outer end region with a flange on which a spring, in particular a helical spring, arranged between the flange and an inner hole shoulder is able to engage and pressurise the stop peg into its release position. For the pneumatic or hydraulic displacement of the pin into its working position, the hole space located radially outside relative to the stop peg can be connected by a channel to the housing interior space or to a space exhibiting a pressure when the axial piston machine is in operation. When the hole space is connected to the housing interior space, the channel can run in the housing wall or longitudinally in the stop peg. In order to provide twice the operational reliability or in order to be able to selectively connect the hole space either to the housing interior space or to the pressure space, it is advantageous to provide two corresponding channels, in each of which is arranged a nonreturn valve which automatically closes under the effect of the pressure which becomes established in each case in the pressure space or of a closing spring.

It is furthermore advantageous to arrange, on the relevant lateral half, or on both lateral halves, of the axial piston machine, in each case only one stop peg parallel to the pivot axis of the swash plate. Such a housing design may be selectively used for immovable or movable swash plates. In this case, it is also advantageous to round the stop peg convexly at its side facing towards the retracting device so as to prevent constraints arising in the case of a pivotable swash plate.

It is also advantageous to arrange the stop peg such that between it and the retracting device there is a small spacing which is merely dimensioned to be of such a size that, in the event of an overload and deformation of the retracting device within its elastic range, the retracting device abuts against the stop peg before it is deformed beyond its yield point.

In addition, it is advantageous if the supporting device is actuated by the restraint device such that the supporting device engages behind the retracting device only when the restraint device is situated in its working position, and otherwise releases it. On actuation of the restraint device, therefore, not only is the swash plate anchored in the housing, but additionally it is ensured that the retracting device is secured to the swash plate. In the demounting position, in which the restraint device is not actuated, not only is the swash plate then released relative to the housing, but additionally the securing of the retracting device with respect to the swash plate is released. The demounting can thus be effected without problems. In this configuration, the supporting device may, for example, have a rotary shaft which is interlocked with the restraint device and is rotated on actuation of the restraint device. It is possible to arrange on the rotary shaft an eccentric projection which engages behind or releases the retracting device depending on the rotary position of the rotary shaft.

The invention and further advantages obtainable by means of the invention will be explained in more detail below with reference to a number of advantageous exemplary embodiments and simplified drawings, in which.

Figure 1:
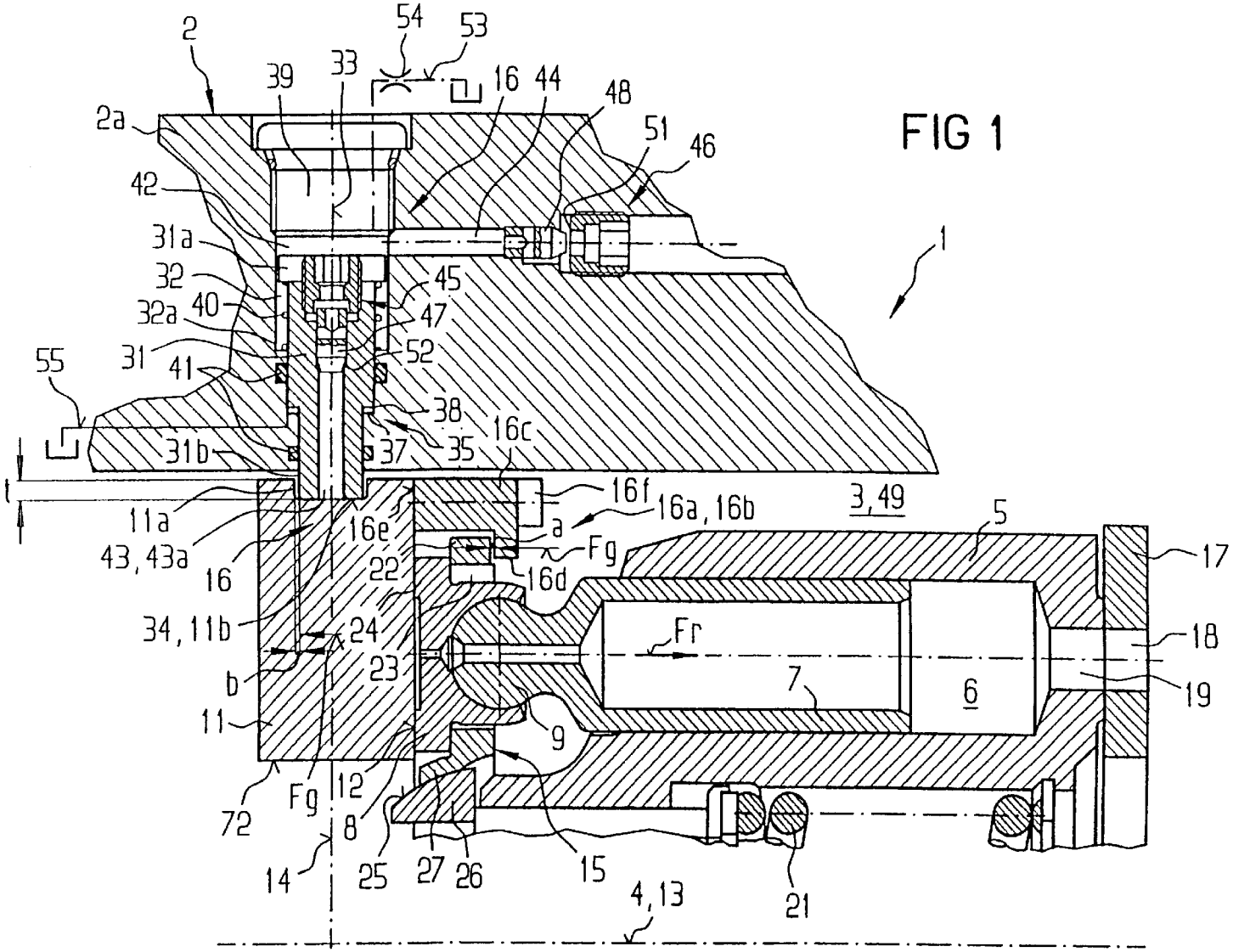
FIG. 1 shows an axial piston machine according to the invention, in partial axial section.

The main parts of the axial piston machine, denoted generally by 1, are a housing 2 with a housing wall 2*a*, which can be seen in section in the drawing, and which encloses a housing interior space 3 in which a cylinder drum 5 with a plurality of cylinder bores 6, preferably distributed over a part of a circle and longitudinally directed, is arranged on a shaft 4, with a plurality of pistons 7 which are mounted to be axially displaceable in the cylinder bores 6, with a plurality of slide shoes 8 which are connected, to be pivotable but axially fixed, to spherical piston heads 9 at one end of the pistons 7, with a swash plate 11 against whose oblique face 12 the slide shoes 8 bear and are axially supported, the swash plate 11 being mounted to be pivotable in a pivot bearing (not shown) about a pivot axis 14 running at right angles to the longitudinal centre axis of the axial piston machine 1 or the axis of rotation 13 of the shaft 4, and being lockable in the respective pivoting position, with a retracting device 15, the purpose of which is to ensure the contact of the slide shoes 8 with the oblique face 12, a restraint device 16 which is intended to stabilise the retracting device 15, and with a control plate 17 which bears against the cylinder drum 5 at the side facing away from the swash plate 11 and, by means of control slots 18 arranged in the control plate 17 and cylinder bore holes 19 in the cylinder drum 5 which cooperate therewith, controls the delivery of the medium, in the present case hydraulic medium, of the axial piston machine 1. A spring 21 prestressing the cylinder drum 5 against the control plate 17 ensures a leaktight contact between the cylinder drum 5 and the control plate 17.

The retracting device 15 is formed by a perforated disc 22 with holes 23 present for the slide shoes 8, the hole borders of which surround the slide shoes in the region of tapered slide-shoe heads with play and, with their side facing towards the swash plate 11, bear against a base flange 24 of the associated slide shoe 8, so that the base flange 24 is held with little play between the oblique face 12 and the perforated disc 22. The perforated disc 22 itself bears, at its side facing away from the swash plate 11, against a locating face of the shaft 4 or of an add-on piece or of the cylinder drum 5, with the result that it is supported in the axial direction facing away from the swash plate 11. The locating face 25 may also be formed on a supporting ring 26 fixed on the shaft 4. In the case of a pivotably mounted swash plate 11, the locating face 25 is a face in the shape of a spherical-ring section, on which the perforated disc 22 is supported by an inner supporting ring 27 which bears, with a tangential or concave bearing face in the shape of a spherical-ring section, against the locating face 25.

The restraint device 16 is formed by a cylindrical or stepped-cylindrical stop pin or stop peg 31 which is mounted to be radially displaceable with little play in a radial guide hole or a guide bore 32 in the housing wall 2*a*, the radial centre axis 33 of which runs at right angles to the axis of rotation 13 and parallel to the pivot axis 14 and is offset relative to the latter on the side opposite the control plate 17. The stop peg 31 is movable between a radially pushed-in working position (shown in the drawing), in which its radially inner pin end 34 overlaps a locating face 11*a*, facing towards the control plate 17, on the swash plate 11 and thus is able to axially support the swash plate 11, and a radially pushed-out release position, in which the pin end 34 is pushed out of the housing interior space 3 or releases the swash plate 22 for axial mounting or demounting. In the present exemplary embodiment, the radial locating face 11*a* is formed by a recess 11*b*,here a blind bore, in the swash plate 11. In the present exemplary embodiment, the recess 11*b* is situated in the central region of the swash plate 11, and the depth t of the recess 11*b* can be a few millimetres, e.g. 3 to 5 mm. To allow for play b, the cross-sectional size of the recess 11*b* is dimensioned larger than the cross-sectional size of the stop peg 31, so that the latter engages with play b in the recess 11*b*, as illustrated in FIG. 1. Preferably, the centre axis 33 of the stop peg 31 is arranged coaxially with the pivot axis 14, in which case the recess 11*b* can be of circular design. If the centre axis 33 is offset axially and possibly also radially relative to the pivot axis 14, a shape of the locating face 11*a* curved in the shape of a circular arc about the pivot axis 14 is required, in which case the recess 11*b* can be formed by an elongated hole curved in the shape of a circular arc. In the pushed-in working position, the stop peg 31 can bear, with its end face, against the bottom of the recess 11*b* and thereby radially support the swash plate 11 or be at a small distance therefrom so as to allow play. In the exemplary embodiment according to FIG. 1, in which the restraint device 16 directly supports the swash plate 11 and directly engages on the swash plate 11, it is necessary to fix the perforated disc 22 to the swash plate 11 in order to allow the restraining action of the restraint device 16 to take effect on the slide shoes 8 as well. In the present configuration, therefore, to fix the slide shoes 8 to the swash plate 11 provision is made for an additional restraint device, namely a supporting device 16*a*, which, while allowing for play a, prevents the perforated disc 22 in a form-fitting manner from lifting off from the sliding face 12. In the present exemplary embodiment, the supporting device 16*a* is formed by two supporting parts 16*b*, arranged diametrically opposite each other in a mirror-image fashion and connected to the swash plate 11, which, in the present exemplary embodiment, are formed with an axial supporting-part leg 16*c*, arranged radially beside the retracting device 15 or beside the perforated disc 22, and a supporting-part leg 16*d*, projecting radially inwards from the supporting-part leg 16*c*, these being integrally joined to each other. The supporting parts 16*b* may also be integrally joined to the swash plate 11 and project from it, for example axially. In the present configuration, the supporting parts 16*b* are separate parts which bear, with a plane bottom face 16*e*, against the plane sliding face 12 of the swash plate 11 and are screwed up to the swash plate 11 by headed screws 16*f* which each pass through the supporting-part leg 16*c* in a through-hole and engage in a threaded hole in the swash plate 11. The radial spacings between the supporting-part leg 16*c* and the perforated disc 22 on the one hand and the housing wall 2*a* on the other hand are each dimensioned to be of such a size that, even in oblique positions of the swash plate 11, a radial spacing is always present. A small axial spacing a is present between the supporting-part leg 16*d* and the retracting device 15, here the perforated disc 22. The bearing face of the supporting-part leg is a plane face, with the result that a low surface pressure and low wear, as well as a long service life are ensured.

Figure 3:
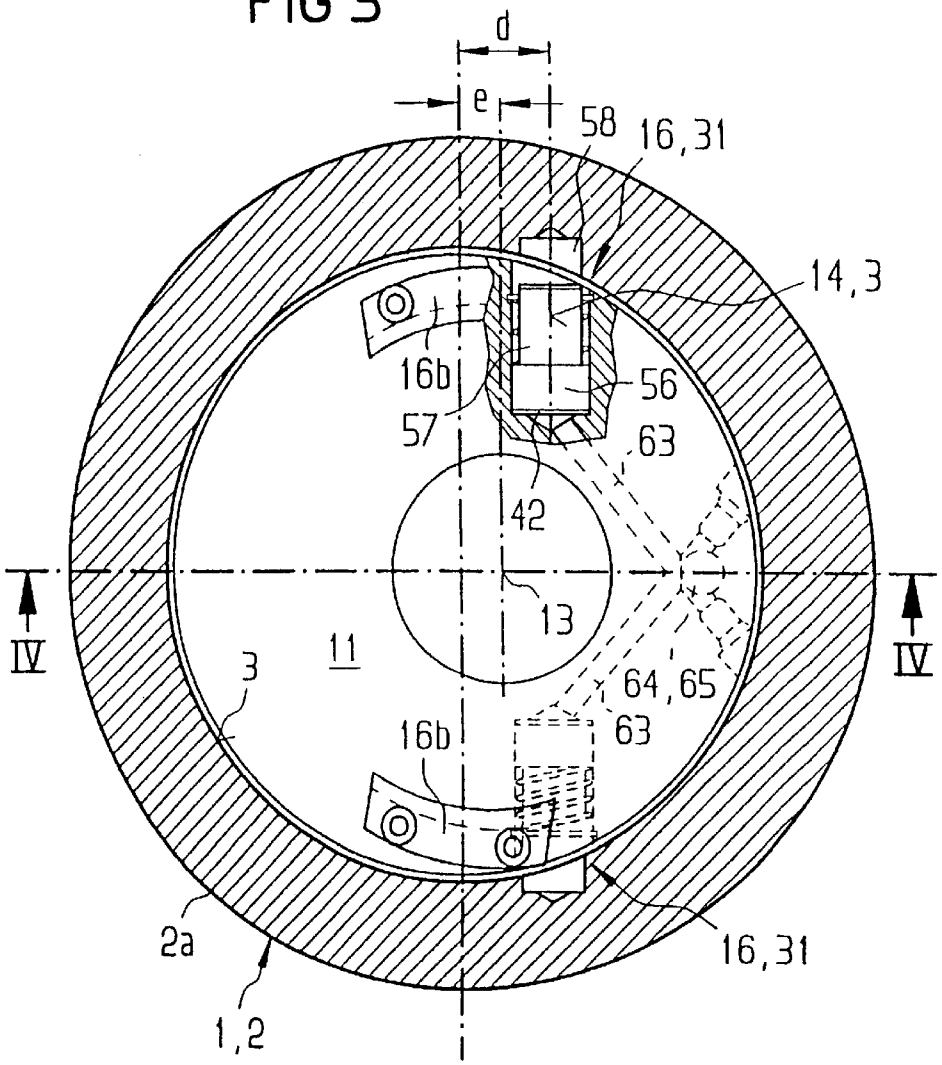
FIG. 3 shows the section III—III in FIG. 2.

As can be seen from FIG. 3, the supporting parts 16*b* —as viewed along the axis of rotation 13—are curved to correspond to the peripheral border of the round perforated disc 22, with the result that a greater overlapping area at the supporting-part leg 16*d* is achieved. From FIG. 3, it can also be seen that each supporting part 16*b* can be screwed up with a plurality of, in particular two, headed screws 16*f*.

The radially inwardly directed movements of the stop peg 31 are limited by a stop 35. This working position is determined by a step face 37 of the stepped guide bore 32 and a step face 38 of the radially outwardly divergently stepped stop peg 31. A closure plug 39 is screwed into the guide bore 32, made from outside, and sealed. To seal the stop peg 31, provision is made for one or two annular seals 41 which are arranged and act, between the wall of the guide bore 32 and the outer circumferential surface of the stop peg 31, in an annular groove on one or both sides of the step faces 37, 38.

The stop peg 31 is prestressed into its release position by the force of a spring 40 which, in the present exemplary embodiment, is formed by a helical spring which engages on a flange 31*a* at the outer end of the stop peg 31 and bears against a step face 32*a* of an outer bore widening 32*b* of the guide bore 32.

The purpose of the restraint device 16 and the supporting device 16*a* is to axially support the retracting device 15 against overloads resulting from tensile forces directed towards the right in the drawing, which are produced by the pistons 7 during a suction stroke and the resultant of which is indicated by the arrow Fr. For adequate support, it is therefore sufficient if the restraint device 16—as viewed axially—is arranged on the side of the axial piston machine 1 on which the pistons 7 perform the suction strokes. In the case of an axial piston machine 1 with a pivotable swash plate 11, as is the case in the present exemplary embodiment, the restraint device 16, here the stop peg 31—as viewed along the axis of rotation 13—is arranged in the region of the pivot axis 14. In this case, the supporting face 31*b* on the stop peg 31, which supporting face in the working position of the stop pin 31 is opposite the retracting device 15 and preferably extends radially relative to the axis of rotation 13, is situated in alignment with the pivot axis 14. In order to avoid constraints on the stop pin 31 during the pivoting of the swash plate 11, it is advantageous to round the supporting face 31*b* convexly relative to the centre axis 33 of the stop pin 31. These features are fulfilled highly advantageously in a simple manner by a cylindrical shape of the stop pin 31. The axial supporting force of the housing is denoted by Fg.

Within the framework of the invention, the spacing b may also be omitted, since no significant relative movement takes place between the swash plates 11 and the stop peg 31. The spacing a and/or b is at most of such a size that, in the event of a large axial load, the retracting device 15 abuts against the supporting face 31*b* and the locating face 11*a* abuts against the stop pin 31 before the retracting device 15 is deformed beyond its elastic deformation range or beyond its yield point. This ensures that it is only in the case of load peaks that the retracting device 15, here the perforated disc 22, can come into contact with the supporting-part leg 16*d* and, indirectly via the swash plate 11, into contact with the supporting face 31*b* and then be actively supported on the housing 2 via the stop peg 31. When the overload ceases, the retracting device 15 returns to its starting position again owing to its elasticity. As a result, friction in particular between the retracting device 15 and the supporting-part leg 16*d* and between the locating face 11*a* and the supporting face 31*b* is avoided in the case of normal loading of the axial piston machine 1, with the result that frictional wear is reduced or where load peaks do not occur is avoided.

In the case of an axial piston machine 1 whose swash plate 11 is pivotable beyond the zero position, a restraint device 16 is to be arranged accordingly on the opposite side in a mirror-image fashion, the restraint device coming into operation when the direction of rotation is reversed.

The hole space situated radially outside the stop peg 31 forms, when the axial piston machine 1 is in operation, a secondary pressure space 42 which is connected by a channel 43, 44 to a primary pressure space in which, when the axial piston machine 1 is in operation, there prevails a pressure which is transmitted through the channel 43, 44 into the pressure space 42 and at the outer end of the stop peg 31 produces a radially inwardly directed pushing force which overcomes the force of the spring 40 and displaces the stop peg 31 into its working position.

The primary pressure space may, for example, be the housing interior space 3 in which, when the axial piston machine 1 is in operation, there arises a sufficient leakage pressure to be able to produce the above-mentioned pushing force. It should be borne in mind here that this interior space pressure produces an opposite force at the end face of the pin end 34 and therefore the effective differential area between the outer and inner end face of the stop pin 31, or the interior space pressure, is to be dimensioned with an appropriate size. In this case, a channel connection is required between the secondary pressure space 42 and the housing interior space 3, and this may be formed by a channel running in the housing wall 2*a* or by a bore 43*a* running longitudinally through the stop peg 31. In another configuration, the pressure space 42 may be connected, by a channel 44 running in the housing wall 2*a* and formed, for example, by a longitudinal bore, to a pressure line of the axial piston machine, which line exhibits a working or control pressure in operation, or to an adjacent hydraulic unit (external pressure), it being necessary for this working or control pressure or external pressure to be of a sufficient size to produce the pushing force which overcomes the force of the spring 40. In this case, too, the opposite force produced by the interior space pressure at the inner end face of the stop peg 31 is to be taken into account and the differential area between the outer and inner end face of the stop peg 31 or the working or control or external pressure is to be dimensioned with an appropriate size.

For reliable operation, in each case one of the two channels 43, 44 is sufficient. For the purpose of improving the adaptability of the axial piston machine 1 to both above-mentioned pressure sources, it is possible for both channels 43, 44 to be present at the same time, in which case only one or both channels can be connected to the associated pressure source. In the latter case, a nonreturn valve 45, 46 whose valve body 47, 48 closes in the direction of the associated pressure source is to be arranged in both channels 43, 44. The valve bodies 47, 48 may be prestressed into their closing position by a spring or they may be arranged to be freely movable without a spring.

If the channel 44 is not connected and the housing interior space 3 is used as the primary pressure space 49, the pressure present in the housing interior space 3 in operation is transmitted through the channel 43 into the secondary pressure space 42, where it produces at the outer end of the stop peg 31 the pushing-in force for displacing the stop peg 31 into its working position. In this case, the nonreturn valve 46 closes automatically by its valve body 48 moving up against the associated valve seat under the pressure which is present. If, in contrast, the channel 44 is connected to a primary pressure source, then the stop peg 31 is displaced by this pressure into its working position, in which case the valve body 47 of the nonreturn valve 45 closes automatically at the associated valve seat 52, with the result that the pressure in the housing interior space 3 remains unaffected and no leakage losses occur.

The nonreturn valves 45, 46 delimit a closed pressure space system in which the pressure has to be relieved before the stop pin 31 can be displaced into its release position, for example for demounting the swash plate 11 or the retracting device 15. This may be effected, for example, by an at least slight opening of the closure plug 39. Another measure for the automatic relief or delayed relief of the pressure space system consists in connecting the pressure space system to the return system or the tank by a small or throttled channel, it being necessary for the throttle to be dimensioned as small as possible to avoid power losses. Such a relief channel 53 with a throttle 54 may be arranged, for example, in the closure plug 39, as shown in outline in the drawing.

Furthermore, it is advantageous, particularly with a larger movement stroke of the stop pin 31, to aerate and deaerate the annular space between the step faces 37, 38 or to connect it by a channel to a substantially unpressurised line for the hydraulic medium. This may be effected by a channel 55, illustrated in outline, which extends from the annular space, for example, to the tank for the hydraulic medium.

Figure 2:
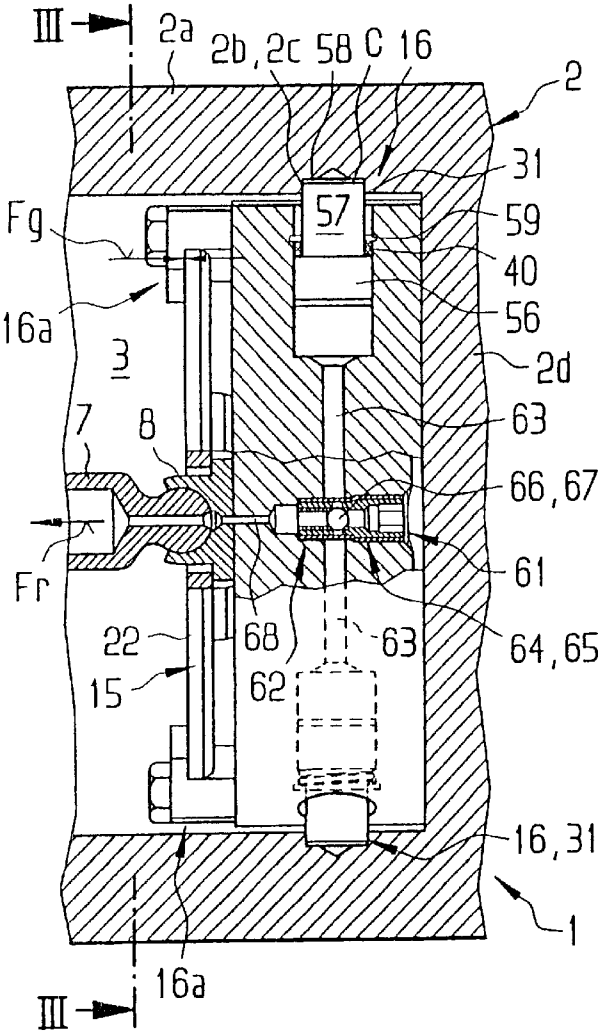
FIG. 2 shows a modified configuration of an axial piston machine according to the invention, in partial axial section.

In the exemplary embodiment according to FIG. 2, in which the same or comparable parts are provided with the same reference symbols, the supporting device 16*a* is of the same design as in the exemplary embodiment according to FIG. 1, but in contrast to FIG. 1 the restraint device 16 is not arranged on the housing 2 but on the swash plate 11 and is mounted to be displaceable between a radially pushed-in release position and a radially pushed-out working position, in which the stop peg 31 engages behind a locating face 2*b* on the housing 2 and is thereby axially supported in the direction of the pistons 7. Here, too, the at least one stop peg 31 is prestressed into its release position by a spring 40 and can be pressurised into its working position by a pressure in a pressure space 42 adjoining the stop peg 31. In this configuration, too, the round stop peg 31 is designed as a stepped piston with a piston 56 and a piston shaft 57 projecting radially outwards therefrom. The piston 56 is mounted to be displaceable in a blind bore 58, arranged approximately radially and in the central region of the swash plate 11 and emerging at the peripheral surface thereof, and is prestressed in the direction of the bottom of the blind bore 58 in each case by the spring 40 designed as a helical spring surrounding the piston shaft 57. The spring 40 acts on the one hand against the piston annular surface and on the other hand against an abutment shoulder 59, which may be formed, for example, by a securing ring which is inserted in an internal groove in the wall of the blind bore 58. The depth of the blind bore 58 and the lengths of the piston 56 and of the piston shaft 57 are coordinated with one another such that, in the pushed-in release position (at the top of FIG. 3), the stop peg 31 is at a distance from the inner surface of the housing wall 2*a* and in the pushed-out working position the stop peg 31 engages behind an approximately radial locating face 2*b* which faces away from the pistons 7 in the axial direction and thereby forms an abutment, providing the supporting force Fg, for the piston forces Fr. In this configuration, too, the locating face 2*b* may be formed by a recess 2*c* or blind bore in the inner circumferential surface of the housing wall 2*a*. As already in the exemplary embodiment according to FIG. 1, in the configuration according to FIGS. 2 to 4, likewise, the supporting force of the housing 2 is denoted by F and also acts on the supporting-part leg 16*d* owing to the transmitting action of the supporting device 16*a*.

The secondary pressure space 42 arranged in the bottom of the blind bore 58 is connected by at least one and, in the present configuration, likewise two channels 61, 62 to a primary pressure space in each case. For both of the above-mentioned channels 61, 62 a common channel 63 extends, for example, secantly through the swash plate 11, this channel intersecting a widened channel section 64 running transversely or axially, in which a valve cartridge 65 is firmly inserted, for example screwed. The channels 61, 62 extend opposite each other from the valve space of a shuttle valve 66 in which a valve body, e.g. a valve ball 67, is mounted to be movable coaxially with the channels 61, 62 and is able to alternately close and open the openings thereof to the channels 61, 62. The channel denoted by 61 opens into the housing interior space 3, whereas the channel denoted by 62 is connected by a throttled channel connection 68, which passes axially through an associated slide shoe 8 and a piston head 9, to the associated piston space and thus to a hydrostatic pressure relief, known per se, for the slide shoe 8 and the associated piston head 9. The pistons 7 are preferably designed as hollow pistons. In the above-described configuration, the stop peg 31 can be selectively pressurised both by the working pressure and by the housing interior space pressure and pushed out into its working position, the valve body 67 automatically closing in each case the channel 61, 62 containing a lower pressure. In operation, the working pressure can perform the pressurising of the pressure space 42. In contrast, the housing interior space pressure can perform the pressurising when the working pressure drops, for example immediately after the axial piston machine 1 has been shut off, it being possible for a housing interior space pressure which still exists for a certain time even after shut-off to keep the stop peg 31 in its pushed-out working position.

In the pushed-out working position, the pushing-out movement of the stop peg(s) 31 is limited by stop against the abutment 59 such that the stop peg 31 is at a radial distance c from the bottom of the recess 2*b* and thus no radial stresses exist between the swash plate 11 and the housing wall 2*b*.

After a relatively long stoppage period or in the event of demounting of the axial piston machine 1, the spring 40 can displace the stop peg 31 into its release position, in which the swash plate 11 can be demounted without problems. As already explained with regard to the first exemplary embodiment, it is sufficient, for an effective axial restraint of retracting device 15, if a stop peg 31 is present preferably in the central region of the suction-or pressure-stroke section of the pistons 7. For the purpose of symmetrical support or in the case of those axial piston machines in which the swash plate 11 is movable beyond its O position, for example for the purpose of a reversal of the direction of rotation, it is advantageous to provide on both sides of the axis of rotation 13 a restraint device 16 and also a supporting device 16*a*, as illustrated in FIG. 2. In this case, both channels 63 intersect the channel 64 containing the valve cartridge 65 for the purpose of connection to the channels 61, 62. The valve cartridge 65 has, in the region of the valve space, one or more radial connecting holes which open into the channel(s) 63. FIG. 5 shows schematically the hydraulic control of the restraint device(s), a throttle 69, 71 for the purpose of throttling the working pressure or the housing interior pressure being arranged in each of the channels 61, 62. Within the framework of the invention, the restraint device(s) 16 may be arranged centrically or—as can be seen from FIG. 3—offset by an amount d and thus eccentrically. Moreover, within the framework of the invention, it is also possible for the pivot axis 14 and the centre axis 31 of the restraint device 16 to be arranged coaxially with each other (not shown). Furthermore, within the framework of the invention, it is also possible for two mutually oppositely arranged round stop pegs 31 to be able to form the pivot bearing of the swash plate 11 if the recesses 2*c*, 11*b* which receive the stop pegs 31 are bearing recesses and in particular are formed by bearing bores. This applies both to the configuration according to FIG. 1 and to that according to FIGS. 2 to 4.

It is also possible within the framework of the invention (FIG. 3) to arrange the hole 66, through which the shaft 4 passes, in the swash plate 11 eccentrically in the housing 2 on the side, see (c), on which the pivot axis 14 and/or the centre axis 31 are offset. In this case, the eccentricity c may be smaller than the offset amount d and preferably be about half the size.

Figure 4:
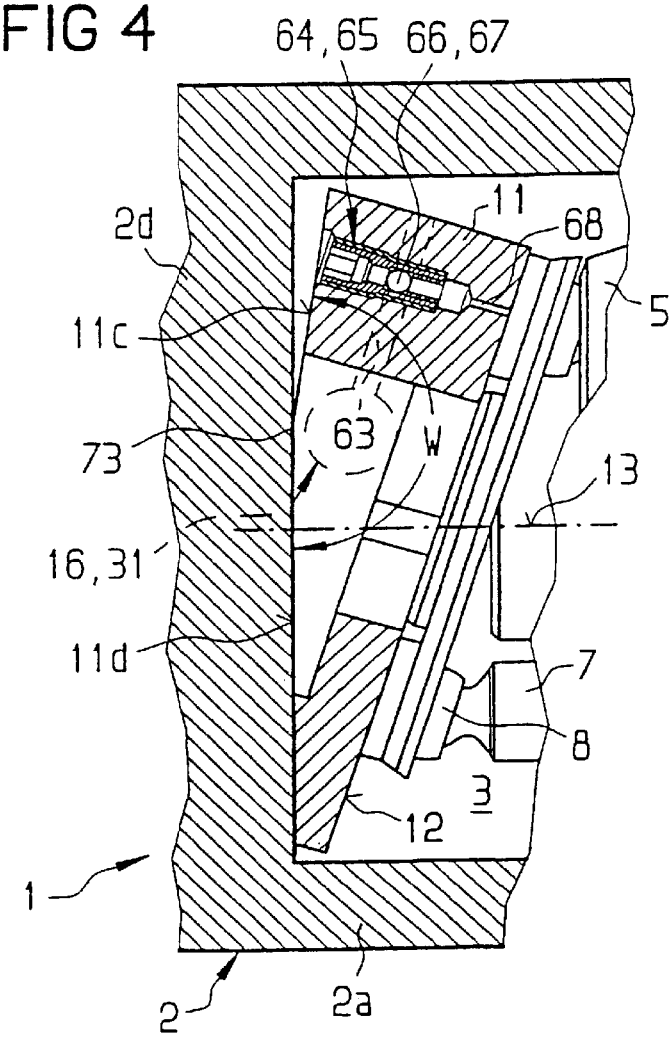
FIG. 4 shows the partial section IV—IV in FIG. 3.
Figure 5:
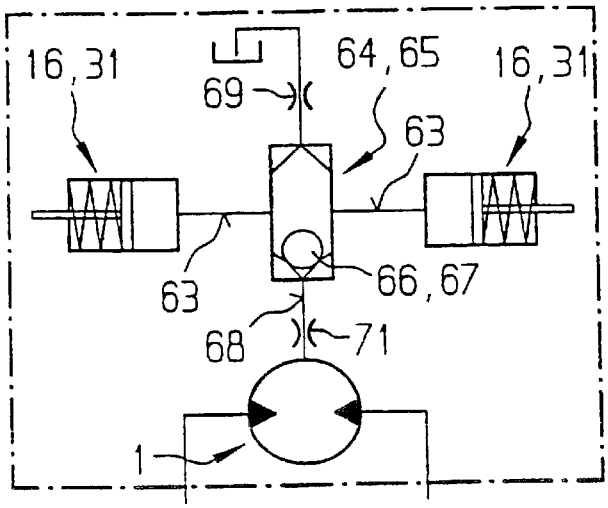
FIG. 5 shows a hydraulic circuit diagram for a detail of the axial piston machine according to the invention.

In the configuration according to FIG. 4, the swash plate 11 has, on its rear side 2, bearing faces 11*c*, lid which enclose an obtuse angle W with each other and are preferably plane, and with which it bears, in its position of minimum and maximum pivoting angle, against the facing end wall 2*d* of the housing 2. In this case, the swash plate 11 can bear against and be axially supported on the end wall 2*d* not only in its pivoting end positions, but, with the vertex 67, also in optional intermediate positions, with the result that the pivot bearing or the pivot bearings, which are present on both sides, of the swash plate 11 are relieved and thus can be designed less sturdily. The bearing contact of the bearing faces 11*c*, 11*d* is advantageous particularly when two stop pegs 31 form the pivot bearing, as shown in outline in FIG. 4.

FIGS. 6 to 10 show a further exemplary embodiment of an axial piston machine 1 according to the invention. This exemplary embodiment largely corresponds to the exemplary embodiments described with reference to FIGS. 2 to 4. Corresponding reference symbols have been assigned to parts which are the same or act the same, so that in this regard repetitive description is unnecessary.

The difference from the exemplary embodiment explained with reference to FIGS. 2 to 4 is that the supporting device 16*a* does not continuously engage behind the retracting device 15, but only when the restraint device 16 is situated in its extended working position. When, in contrast, the restraint device 16 is situated in its normal unextended position, the supporting device 16*a* releases the retracting device 15. This substantially facilitates the demounting of the axial piston machine 1.

Figure 6:
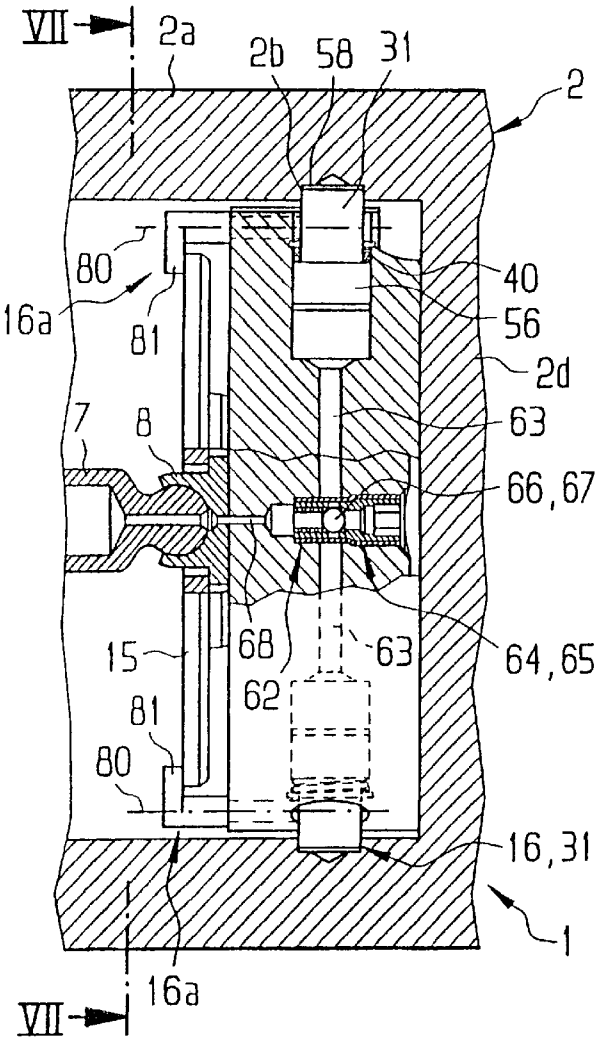
FIG. 6 shows a further modified configuration of an axial piston machine according to the invention, in partial axial section.

In the exemplary embodiment illustrated in FIGS. 6 to 10, the supporting device 16*a* comprises in each case a rotary shaft 80. Arranged on, or formed in one piece with, the rotary shaft 80 is an eccentric projection 81 which is plate-shaped in the exemplary embodiment. The rotary shaft 80 is in engagement with the stop peg 31 of the restraint device 16. When the stop peg 31 is displaced from the normal position illustrated in FIG. 7 into the working position illustrated in FIG. 6, this translational movement of the stop peg 31 brings about a rotary movement of the rotary shaft 80 and thus a rotation of the eccentric projection 81 on each rotary shaft 80. The eccentric projection 81 is arranged here such that it engages behind the retracting device 15 only when the stop peg 31 of the restraint device 16 is situated in its working position, as illustrated in FIG. 6. When, in contrast, the stop peg 31 is situated in its normal position illustrated in FIG. 7, the eccentric projection 81 of the two rotary shafts 80 does not engage behind the retracting device 15, so that the retracting device 15 and the components connected thereto can be demounted without problems.

Figure 7:
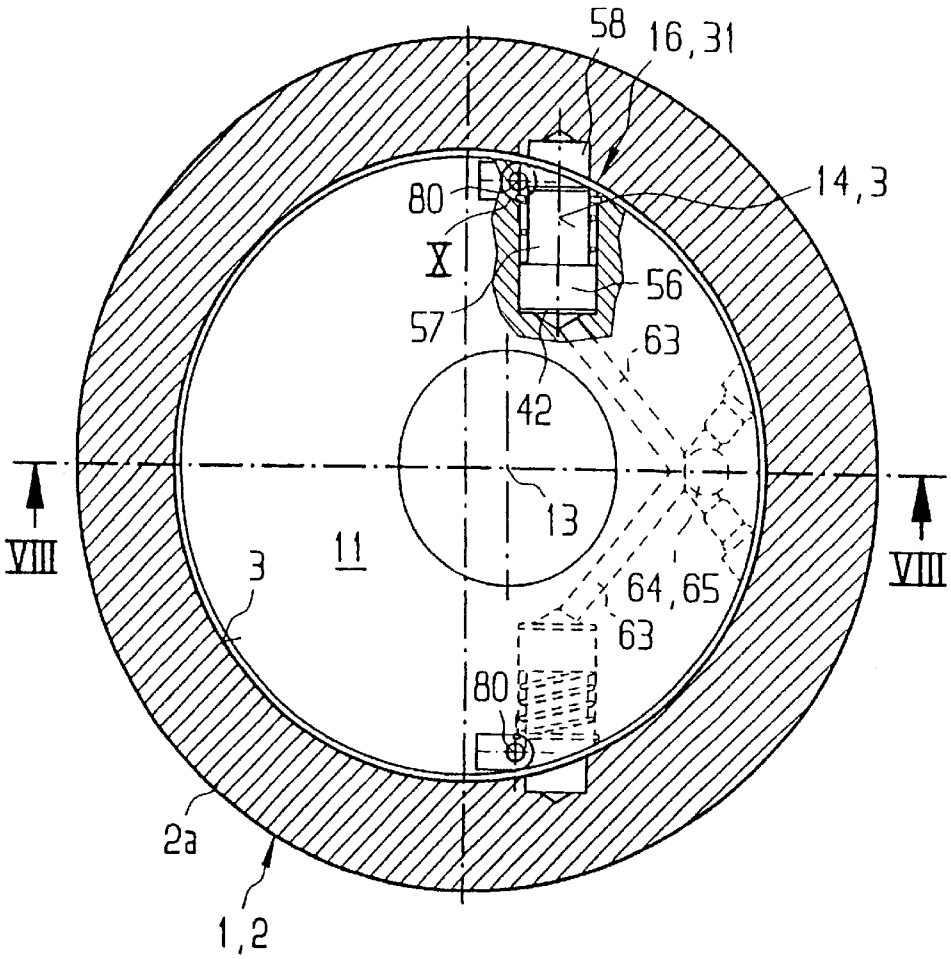
FIG. 7 shows the section VII—VII in FIG. 6.
Figure 8:
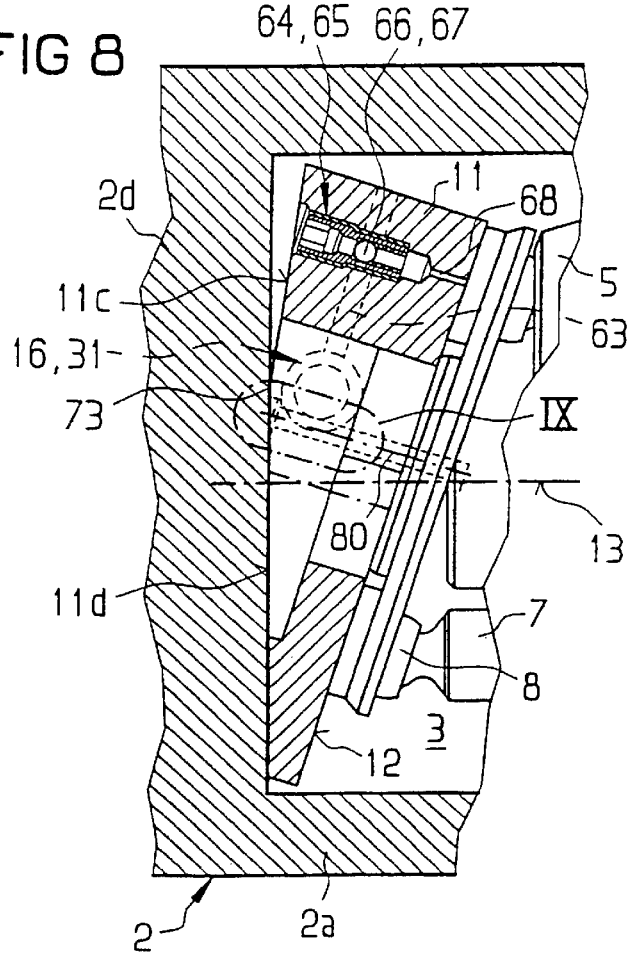
FIG. 8 shows the partial section VIII—VIII in FIG. 7.
Figure 9:
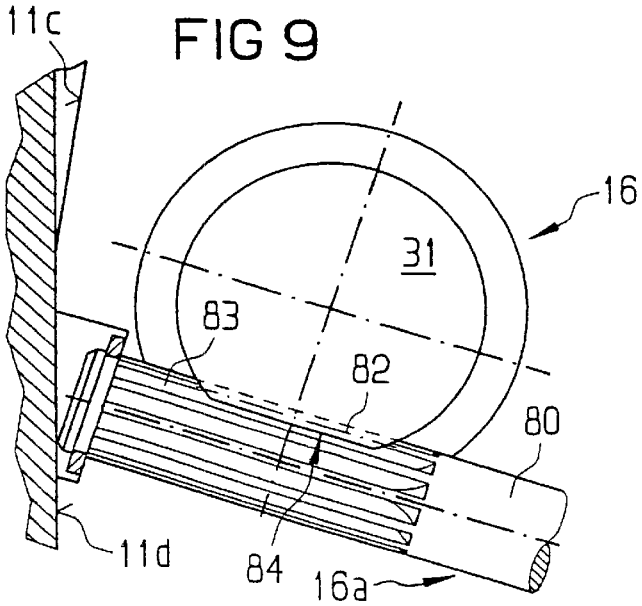
FIG. 9 shows the detail IX in FIG. 8, in an enlarged representation.
Figure 10:
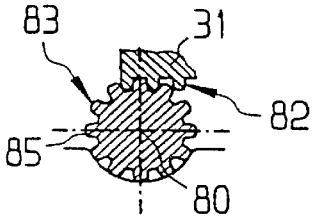
FIG. 10 shows the detail X in FIG. 7, in an enlarged representation.

As is apparent both from FIG. 9, which illustrates the detail IX in FIG. 8 in enlarged form, and from FIG. 10, which illustrates the detail X in FIG. 7 in enlarged form, the stop peg 31 has a toothing 82 which meshes with a toothing 83 on the rotary shaft 80. In the exemplary embodiment, the toothing 82 of the stop peg 31 is designed in the manner of a toothed rack on a flattened area 84 of the stop peg 31. Alternatively, however, the toothing 82 could also be formed by grooves running around the circumferential surface of the stop peg 31. The rotary shaft 80 is designed, in the region in which it is in engagement with the stop peg 31, as a toothed wheel with teeth 85 distributed around the periphery. Through the toothing 83, the rotary shaft 80 is operatively connected to the assigned stop peg 31 such that in the event of a displacement or translational movement of the stop peg 31 the rotary shaft 80 performs a rotary movement.

In the exemplary embodiments described with reference to FIGS. 6 to 10, it is particularly advantageous that both an anchoring of the swash plate 11 on the housing 2 and of the retracting device 15 on the swash plate 11 is brought about automatically or in a self-acting manner by the actuation of the restraint device 16. As soon as a housing interior pressure has become established in the housing interior space 3, or a system pressure is available via the channel connection 68, the restraint device 16 according to the invention is actuated and brings about the anchoring described. In the event of demounting, this anchoring is automatically removed, thereby considerably simplifying maintenance work.

What is claimed is:

1. Axial piston machine (1) with a housing (2), with a cylinder drum (5) which is arranged to be rotatable in a housing interior space (3) and in which there are formed a plurality of cylinder bores (6) in which pistons (7) are movably guided, which pistons are supported on a swash plate (11) via slide shoes (8), with a retracting device (15) on which the slide shoes (8) are supported during the retracting movement of the pistons (7), and with a restraint device (16) which is mounted in the housing (2) and is movable against a spring (40) and the purpose of which is to support the retracting device (15) on the housing (2), characterised in that the retracting device (15) has engaging therebehind, on its side facing away from the swash plate (11), a supporting device **(16*a*) connected to the swash plate (11), wherein there is provision, between the supporting device (16*a*) and the retracting device (15), for an axial spacing (a) which is dimensioned to be of such a size that, when the axial piston machine (1) is in operation, the retracting device (15) abuts against the supporting device (16*a*) before the retracting device (15) is deformed beyond its elastic deformation limit, and the restraint device (16), in the working position thereof pushed into the housing interior space (3), engages behind a substantially radial locating face (11*a*) on the swash plate (11)** or an add-on piece thereof.

2. Axial piston machine (1) with a housing (2), with a cylinder drum (5) which is arranged to be rotatable in a housing interior space (3) and in which there are formed a plurality of cylinder bores (6) in which pistons (7) are movably guided, which pistons are supported on a swash plate (11) via slide shoes (8), with a retracting device (15) on which the slide shoes (8) are supported during the retracting movement of the pistons (7), and with a restraint device (16) which is movable against a spring (40) and the purpose of which is to support the retracting device (15) on the housing (2), characterised in that the retracting device (15) has engaging therebehind, on its side facing away from the swash plate (11), a supporting device **(16*a*) connected to the swash plate (11), and in that the restraint device (16) is arranged to be substantially radially movable on the swash plate (11) and can be moved into a working position in which it engages behind a locating face (2*b*) on the housing (2)**.

3. Axial piston machine according to claim 2, characterised in that the restraint device (16) is pressurised by an adjoining pressure space (42) such that the restraint device (16) is pushed into the working position when a pressure is present in the pressure space (42), the pressure space (42) being connected to the housing interior space (3) and/or to a line (44) which conducts pressure when the axial piston machine is in the operating state, and in that the restraint device (16) is biased by the spring (40) such that the restraint device (16) is displaced into a release position, which releases the locating face **(11*a*), when the pressure space (42)** is substantially unpressurised.

4. Axial piston machine according to claim 1 or 2, characterised in that the restraint device (16) is arranged, relative to the longitudinal centre axis (13) of the axial piston machine (1), on the side on which the pistons (7) each perform a suction stroke, or a restraint device (16) is arranged on both sides.

5. Axial piston machine according to claim 1 or 2, characterised in that the restraint device (16) is formed by one or more stop pegs (31) arranged spaced apart in the peripheral direction of the housing (2), which stop pegs are each displaceable, in an approximately radial guide (32, 58) in the housing (2) or on the swash plate (11), between their working position engaging behind the locating face **(11*a*; 2*b*)** and a release position releasing the latter.

6. Axial piston machine according to claim 5, characterised in that the guide is a guide hole (32), in particular a stepped hole, and the stop peg (31) is an in particular step-shaped pin or peg.

7. Axial piston machine according to claim 6, characterised in that a stop or step face (37, 38) limits the movement of the stop peg (31) into its working position.

8. Axial piston machine according to claim 7, characterised in that the stop peg (31), in its working position, has its end side at a distance (c) from a facing surface of the housing (2) or of the swash plate (11).

9. Axial piston machine according to claim 1 or 2, characterised in that the swash plate (11) is mounted in a pivot bearing to be pivotable about a transversely running pivot axis (14).

10. Axial piston machine according to claim 9, characterised in that the restraint device (16) is formed by a stop peg (31) which is arranged in an axial plane of the axial piston machine (1) containing the pivot axis (14), on one or both sides of the axial piston machine (1) relative to the axis of rotation (13) of the axial piston machine (1).

11. Axial piston machine according to claim 5, characterised in that the stop peg (31) is convexly rounded on its side facing towards the locating face **(11*a*, 2*b*)**, and has a cylindrical cross-sectional shape.

12. Axial piston machine according to claim 1 or 2, characterised in that the locating face **(11*a*; 2*b*) is formed on the swash plate (1) or on the housing (2) by a recess (11*b*; 2*c*)**, in particular by a blind bore.

13. Axial piston machine according to claim 1 or 2, characterised in that the supporting device **(16*a*) is formed by one annular or at least two mutually radially opposite supporting parts (16*c*), each of which extends axially from the swash plate (11) in the direction of the cylinder drum (5) and at the same time engages over and behind the retracting device (15)**.

14. Axial piston machine according to claim 13, characterised in that the supporting part(s) **(16*c*) is(are) each formed by a separate component which is fastened, preferably by at least one screw (16*f*), to the side of the swash plate (11) facing axially towards the cylinder drum (5)**.

15. Axial piston machine according to claim 13, characterized in that the supporting part(s) **(16*c*) is(are) curved in the shape of a circle or in the shape of a circular arc relative to the centre axis of the cylinder drum (5)**.

16. Axial piston machine according to claim 9, characterised in that two mutually oppositely arranged restraint devices (16) form the pivot bearing for the swash plate (11).

17. Axial piston machine according to claim 1 or 2, characterised in that the restraint device (16) is offset transversely by an amount (d) relative to a longitudinal median plane of the cylinder drum (5).

18. Axial piston machine according to claim 2, characterised in that there is provision, between the restraint device (16) and the locating face (11*a*; 2*b*) and/or between the supporting device (16*a*) and the retracting device (15), for an axial spacing (a and/or b) which is dimensioned to be of such a size that, when the axial piston machine (1) is in operation, the retracting device (15) abuts against the restraint device (16) before the retracting device (15) is deformed beyond its elastic deformation limit.

19. Axial piston machine according to claim 3, characterised in that the pressure space (42) is connected to the housing interior space (3) by a first connecting channel (43) running in the associated housing wall (2*a*) or in the swash plate (11) or longitudinally in the stop peg (31).

20. Axial piston machine according to claim 19, characterised in that the pressure-conducting line has a second connecting channel (44), which opens into the pressure space (42) and is located in the housing wall (2*a*).

21. Axial piston machine according to claim 20, characterised in that a nonreturn valve (45, 46) is arranged in each of the connecting channels (43, 44).

22. Axial piston machine according to claim 21, characterised in that the pressure space system delimited by the nonreturn valves (45, 46) and containing the pressure space (42) is connected by a throttled line (53) to a line of correspondingly low pressure (return, line, leakage, line or tank).

23. Axial piston machine according to claim 1 or 2, characterised in that the supporting device (16*a*) is actuated by the restraint device (16) such that the supporting device (16*a*) engages behind the retracting device (15) only when the restraint device (16) is situated in its working position, and otherwise releases it.

24. Axial piston machine according to claim 23, characterised in that the supporting device (16*a*) comprises one or more rotary shafts (80), on each of which is arranged an eccentric projection (81) which engages behind or releases the retracting device (15) depending on the rotary position of the rotary shaft (80).

25. Axial piston machine according to claim 24, characterised in that the restraint device (16) comprises one or more stop pegs (31) arranged spaced apart in the peripheral direction of the housing (2), the stop pegs (31) having a toothing (82) in each of which a toothing (83) of the rotary shafts (80) of the supporting device (16*a*) engages.

26. Axial piston machine according to claim 1, characterised in that there is provision, between the restraint device (16) and a locating face (11*a*) on the swash plate (11) for an axial spacing (b) which is dimensioned to be of such a size that, when the axial piston machine (1) is in operation, the retracting device (15) abuts against the restraint device (16) before the retracting device (15) is deformed beyond its elastic deformation limit.

27. Axial piston machine according to claim 26, characterised in that the restraint device (16) is pressurised by an adjoining pressure space (42) such that the restraint device (16) is pushed into the working position when a pressure is present in the pressure space (42), the pressure space (42) being connected to the housing interior space (3) and/or to a line (44) which conducts pressure when the axial piston machine is in the operating state, and in that the restraint device (16) is biased by the spring (40) such that the restraint device (16) is displaced into a release position, which releases the locating face (11*a*), when the pressure space (42) is substantially unpressurised.

* * * * *